US007021962B2

(12) United States Patent
Kiyota

(10) Patent No.: US 7,021,962 B2
(45) Date of Patent: Apr. 4, 2006

(54) ELECTRIC CONNECTION BOX AND METHOD OF ASSEMBLING SAME

(75) Inventor: Hirotaka Kiyota, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/814,132

(22) Filed: Apr. 1, 2004

(65) Prior Publication Data

US 2004/0198080 A1 Oct. 7, 2004

(30) Foreign Application Priority Data

Apr. 2, 2003 (JP) ..... P2003-099008

(51) Int. Cl.
*H01R 13/60* (2006.01)

(52) U.S. Cl. ..... 439/528; 439/638; 439/76.2

(58) Field of Classification Search ..... 439/76.2, 439/949, 528, 622, 651, 652, 638
See application file for complete search history.

(56) References Cited

U.S. PATENT DOCUMENTS 6,537,105 B1 * 3/2003 Higashida et al. ..... 439/528

FOREIGN PATENT DOCUMENTS

| | | |
|---|---|---|
| JP | 58-65781 A | 5/1983 |
| JP | 59-82975 A | 6/1984 |
| JP | 3-7602 A | 1/1991 |
| JP | 3-35674 A | 4/1991 |
| JP | 5-58922 A | 8/1993 |
| JP | 8-47144 A | 2/1996 |

* cited by examiner

*Primary Examiner*—Javaid H. Nasri
(74) *Attorney, Agent, or Firm*—Sughrue Mion, PLLC

(57) ABSTRACT

An electric connection box includes: a box body; a provisionally-attaching portion for provisionally attaching a first connector connected to a wire harness to the box body, provided to the box body; and a circuit unit including a second connector adapted to be mounted on the box body. When the circuit unit is mounted to the box body, the first connector is detached from the provisionally-attaching portion and is connected to the second connector.

6 Claims, 9 Drawing Sheets

ELECTRIC CONNECTION BOX AND METHOD OF ASSEMBLING SAME

BACKGROUND OF THE INVENTION

This invention relates to an electric connection box on which an electronic control unit for an automobile, together with electrical parts (such as relays and fuses), are mounted, and the invention also relates to a method of assembling this electric connection box.

As examples of the related art relating to this kind of electric connection box, there are known those shown in FIGS. 10 to 13 (for example, Patent Literatures 1 to 4).

FIG. 10 (Patent Literature 1) shows a wiring structure of a relay box (electric connection box) 53 which is to be combined with a mating fuse box 50. Fuses 52 are received in the fuse body 50, and relays 54 are received in the relay box 53. The boxes 50 and 53 are combined together by engaging an engagement portion 51, formed on a side wall of the fuse box 50, in an engagement reception portion 55 formed on a side wall of the relay box 53.

A harness-passing through hole is formed through one side wall of the relay box 53, and a wire harness 58 is passed through this through hole, and one end portion of this wire harness is extended to the exterior through a through hole 56 formed through another side wall. The thus outwardly-extended wire harness 58 is connected via connectors 57 to the fuses 52 within the fuse box 50.

FIG. 11 (Patent Literature 2) shows a box body 60 of an electric connection box in which a plurality of connectors are mounted. The box body 60 is made of a synthetic resin, and mounting portions 62 on which connectors can be mounted, respectively, are formed integrally on an inner surface 61 of this box body. A lock portion 63 for engagement with a lock portion of the corresponding connector is formed within each of the mounting portions 62.

With respect to the specification of the mounting portions 62, these mounting portions have the same shape, and therefore the connectors can be mounted in a suitable layout on the box body 60 so as to suitably meet a change in circuitry or specification.

FIG. 12 shows a lock structure of relay boxes (electric connection boxes) 65 and 67. Pairs of convex thickened portions 66 and 66, each having a guide groove 66*a*, are formed on one outer surface of one relay box 65, and fitting plate portions 68 for the pairs of guide grooves 66*a* and 66*a* are formed integrally on the other relay box 67.

The fitting plate portion 68 is connected through an interconnecting piece portion 68*b* to bottom portions of a pair of guide ribs 70 and 70 formed on and projecting from one outer surface of the relay box. A slit 71 is formed in a central portion of the fitting plate portion 68, and a pair of right and left elastic piece portions 68*a* and 68*a* are formed as a result of formation of this slit 71. The pair of elastic piece portions 68*a* and 68*a* have elasticity in a direction of the length of the relay box, and also have elasticity in a direction of the thickness of the fitting plate portion 68. Therefore, when the pair of elastic piece portions 68*a* and 68*a* are inserted into the pair of guide grooves 66*a* and 66*a*, respectively, the elastic piece portions 68*a* are elastically deformed, and are fitted respectively in these guide grooves without shaking because of their restoring force.

FIG. 13 (Patent Literature 4) shows a lock cancellation structure of a connector. A pair of lock cancellation piece portions 76 and 76 are formed at a distal end portion of an elastic retaining piece portion 75 formed by notching a wall of a connector housing. A retaining projection 75*a* for engagement with an engagement projection on a mounting panel is formed on an outer surface of the elastic retaining piece portion 75.

Each lock cancellation piece portion 76 has a slanting surface 76*a*, and when an inserted lock cancellation tool 77 presses the slanting surface 76*a*, the lock cancellation piece portions 76 are elastically deformed into a fitting space in the connector housing, so that the locking engagement of the retaining projection 75*a* with the engagement projection is canceled.

Patent Literature 1

JP-A-8-47144

Patent Literature 2

JP-UM-A-59-82975

Patent Literature 3

JP-UM-A-3-7602

Patent Literature 4

JP-UM-A-3-35674

However, the electric connection boxes, the lock structures, etc., shown in the above conventional examples, have the following problems which should be solved.

In the wiring structure of the relay box 53 of the first conventional example, the wire harness 53, which passes through the interior of the relay box 53, and is extended to the exterior, is connected via the connectors 57 to the fuses 52 within the fuse box 50. During the transport of the relay box 53, the wire harness 58, extended to the exterior, hangs in midair, and therefore the wire harness 58 can be entangled, and the connectors 57 can be caught by the wire harness 58, and the connectors 57 can interfere with other part to be damaged.

In the box body 60 of the electric connection box shown in the second conventional example, the amount of projecting of each mounting portion 62 from the inner surface 61 is so large that an excessive gap is formed between the mounted connector and the inner surface 61, and this invites a problem that a part-mounting space can not be effectively utilized.

In the lock structure of the relay boxes 65 and 67 shown in the third conventional example, each fitting plate portion 68, having the pair of elastic piece portions 68*a* and 68*a*, is inserted into the guide grooves 66*a* provided at the outer surface of the one relay box 65, thereby preventing the pair of relay boxes 65 and 57 from shaking relative to each other. However, the convex thickened portions 66, each having the guide groove 66*a*, project outwardly from the outer surface, and therefore during the transport, the convex thickened portions 66 can interfere with other part to be deformed.

In the lock cancellation structure of the connector shown in the fourth conventional example, when the lock cancellation piece portion 76, formed at the distal end portion of the elastic retaining piece portion 75, is pressed by the lock cancellation tool 77, the elastic retaining piece portion 75 is elastically deformed, thereby canceling the locking engagement of the retaining projection 75*a* with the engagement projection. However, a space for the insertion of the bar-like lock cancellation tool 77 thereinto need to be provided at the inner side of a generally U-shaped sliding rail, and therefore the amount of projecting of the sliding rail must be made relatively large, and this invites a problem that an extra gap is formed between the connector and the inner surface.

SUMMARY OF THE INVENTION

With the foregoing in view, it is an object of this invention to provide an electric connection box and a method of assembling this electric connection box, in which a wire harness is prevented from hanging in midair from a box body, thereby preventing the wire harness and a connector from being damaged, and also the connector, connected to the wire harness, can be easily attached and detached, and the efficiency of an assembling operation is enhanced.

In order to solve the aforesaid object, the invention is characterized by having the following arrangement.

(1) An electric connection box comprising:

a box body;

a provisionally-attaching portion for provisionally attaching a first connector connected to a wire harness to the box body, provided to the box body; and a circuit unit including a second connector adapted to be mounted on the box body, wherein when the circuit unit is mounted to the box body, the first connector is detached from the provisionally-attaching portion and is connected to the second connector.

(2) The electric connection box according to (1), wherein the provisionally-attaching portion is formed on a wall portion of the box body forming a receiving space for receiving the circuit unit, and when the circuit unit is receiving in the receiving space, the provisionally-attaching portion is disposed between the wall portion and the circuit unit.

(3) The electric connection box according to (2), wherein the provisionally-attaching portion includes a guide rib which is formed on the wall portion and extends in a direction in which the first connector is inserted, and the first connector includes a guide groove for sliding engagement with the guide rib.

(4) The electric connection box according to (3), wherein the provisionally-attaching portion includes a pair of side ribs provided at opposite sides of the guide rib, respectively, and the first connector includes a pair of side guides for engagement respectively with the pair of side ribs.

(5) The electric connection box according to (3), wherein the provisionally-attaching portion includes retaining projections having a generally semi-circular cross-section formed respectively on a pair of overhang portions formed respectively on opposite sides of the guide rib, and the first connector includes retaining steps for being retained respectively by the retaining projections formed respectively on flange walls of the guide groove.

(6) A method of assembling an electric connection box comprising the steps of:

provisionally-attaching a first connector connected to a wire harness to a provisionally-attaching portion provided to a box body;

transporting the box body in a state that the first connector is provisionally-attached to the provisionally-attaching portion;

detaching the first connector from the provisionally-attaching portion when a circuit unit including a second connection is to be mounted on the box body; and connecting the first connector to the second connecter.

DETAILED DESCRIPTION OF PREFERRED EMBODIMENTS

A preferred embodiment of the present invention will now be described in detail with reference to the drawings.

FIGS. 1 to 9 show one preferred embodiment of an electric connection box of the invention and a method of assembling it.

Figure 1A:
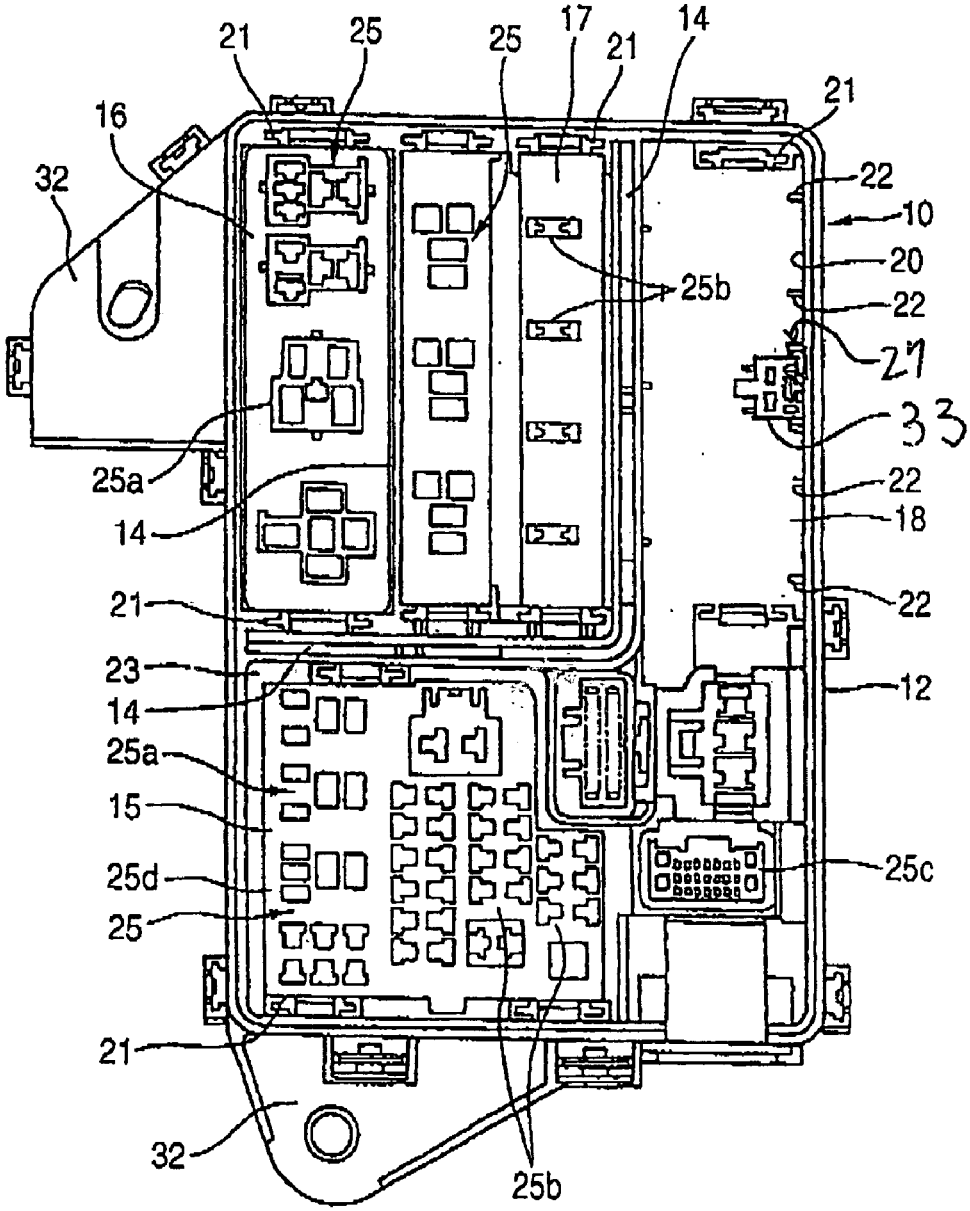
FIGS. 1A–1C are plan views showing one preferred embodiment of an electric connection box of the present invention and a method of assembling it.
Figure 1B:
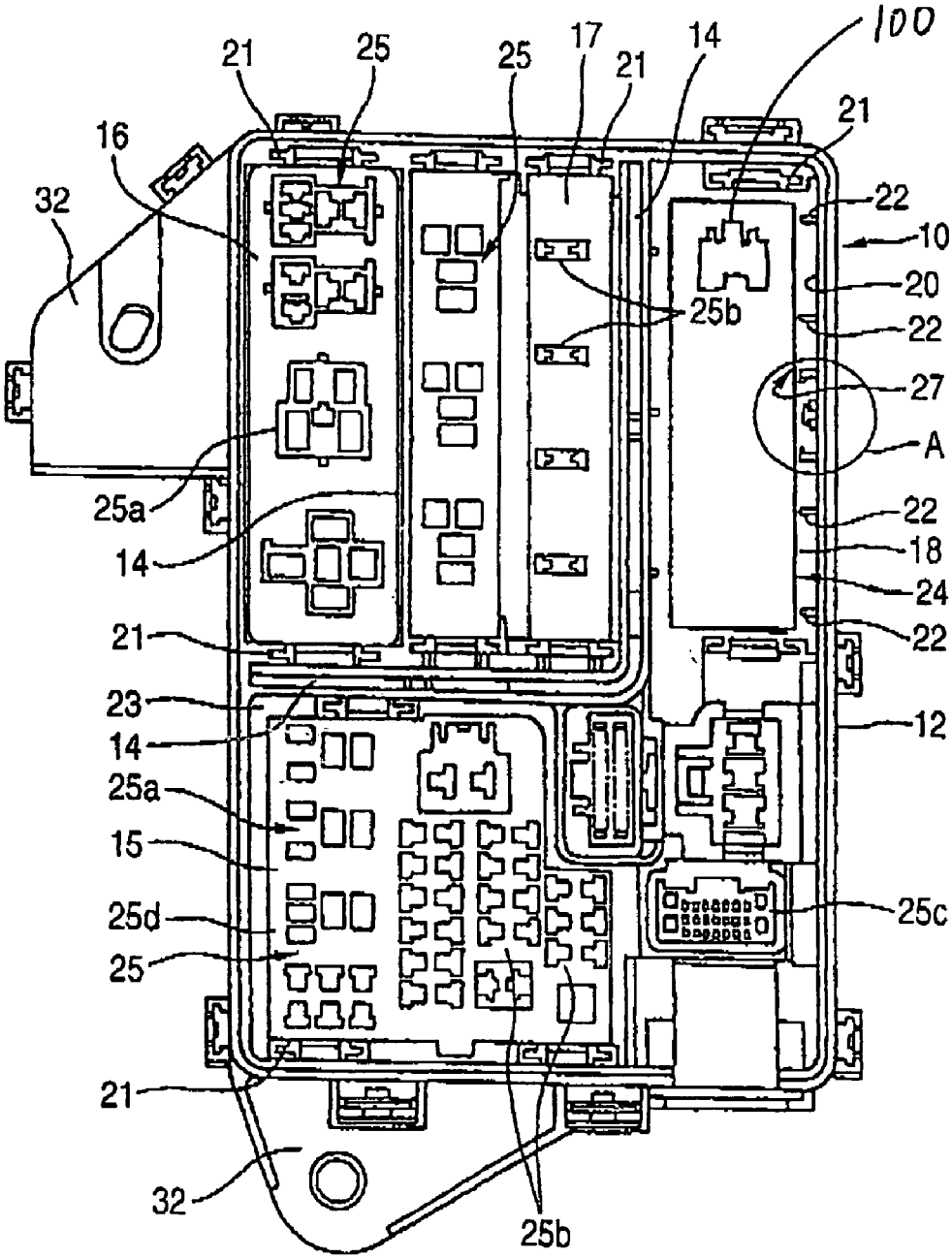
Figure 1C:
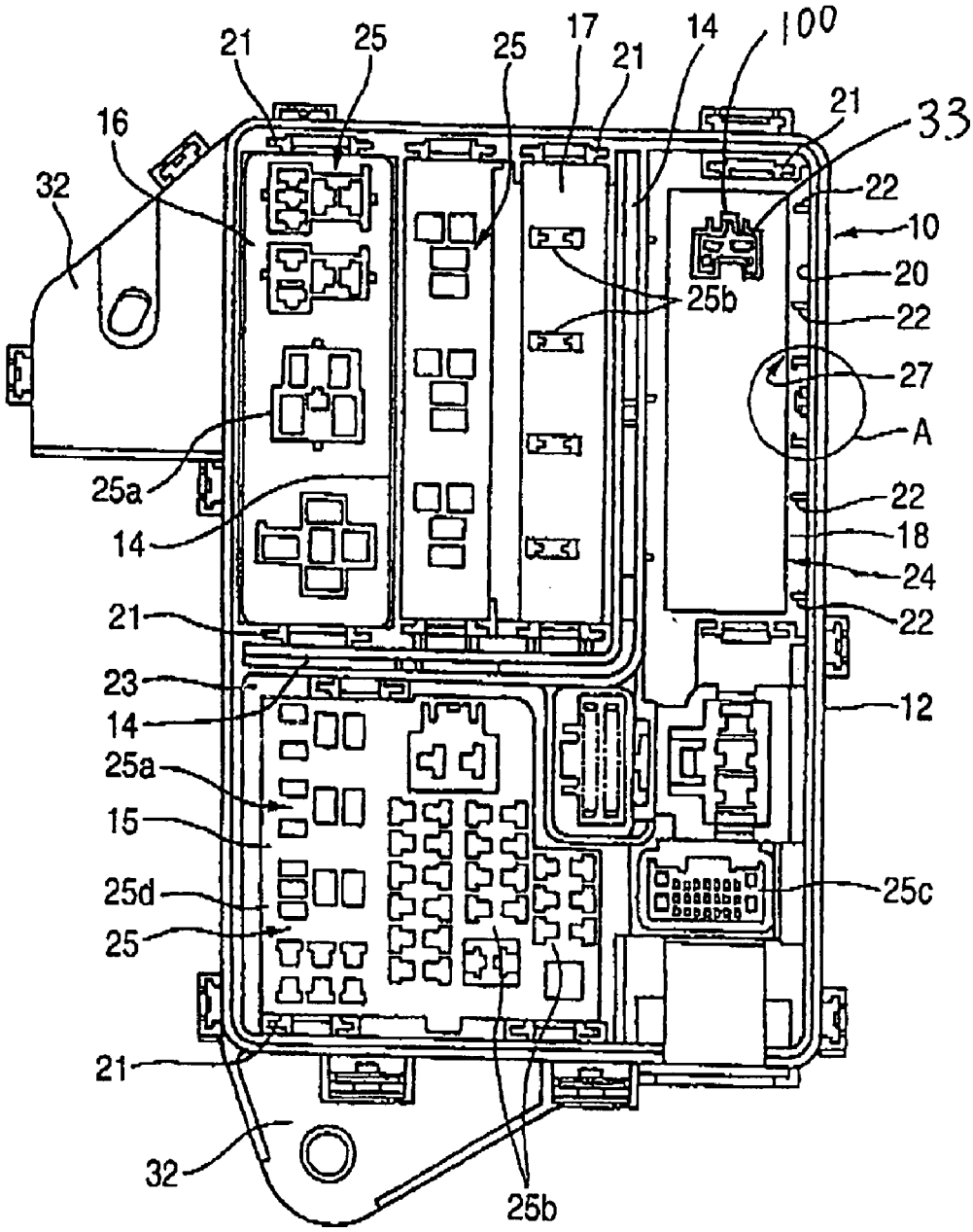

The electric connection box 10, shown in FIGS. 1A–1C, is an electrical connection part which is directly mounted in an engine room of an automobile, and relays electrical connection relative to electrical equipments such as instruments, and controls the operations of on-vehicle equipments. Electrical parts, such as relays 25*a*, fuses 25*b* and a directly-mounting connector 25*c*, and a lamp system control unit (circuit unit) 24 are mounted on this electric connection box, so that this electric connection box performs the above functions.

In more detail, FIG. 1A shows a state in which a male connector 33 is provisionally attached to provisionally-attaching portion 27. FIG. 1B shows a state in which the male connector is detached from the provisionally-attaching portion 27 and a lamp system control unit 24 having a second connector 100 mounted on a main body. Further, FIG. 1C shows a state in which the male connector 33 is connected to the second connector 100 of the lamp system control unit 24 mounted on the main body.

The electrical parts, such as the relays 25*a* and the fuses 25*b*, are combined as units or electrical part blocks 25, and these blocks 25 are mounted on a box body 12 in a cassette manner. One object of the invention is to enhance the efficiency of the operation for assembling the electric connection box 10, and the plurality of electrical parts are combined as the units, and these units are sequentially mounted on the box body 12, and by doing so, the electrical connection box 10 can be efficiently assembled.

Namely, in the electric connection box 10, the plurality of parts and the units, connected to a wire harness, can be assembled in different steps, and therefore the efficiency of the operation for assembling the electric connection box can be enhanced by both of an car maker and a parts maker.

The electric connection box 10 of the invention is characterized in that the box body 12 is provided with a provisionally-attaching portion 27 to which a male connector (one connector) 33, connected to an end portion of the wire harness (which is connected to the electrical part blocks 25, and passes through the interior of the box body 12), can be provisionally-attached.

This provisionally-attaching portion 27 is formed in a projected manner on an inner surface (wall portion) 20 of a receiving space 18 for receiving the lamp system control unit 24, and the male connector 33 can be provisionally attached to the provisionally-attaching portion 27 in a detachable condition. When the lamp system control unit 24 is to be later mounted on the box body 12, the provisionally-attached male connector 33 is detached from the provisionally-attaching portion, and is connected to a female connector (the other connector which is not shown) provided at the lamp system control unit 24.

Here, the male connector 33 and the female connector are so defined in this embodiment, and in actual use, the connector, provided at the wire harness, can be a female connector while the connector, provided at the lamp system control unit, can be a male connector. In this specification, the connector, having a male connector housing 33*a* in which female terminals are inserted, is defined as the male connector 33, while the connector, having a female connector housing in which male terminals are inserted, is defined as the female connector.

The electric connection box of this embodiment will be described in detail in the following.

As shown in FIGS. 1A–1C, the electric connection box 10 includes the resin-molded box body 12 of a frame-like shape, resin-molded covers (not shown) for respectively closing upper and lower openings 23 of the box body 12, and the wire harness (not shown) which electrically connects the electrical part blocks 25 and lamp system control unit 24 (which are received in the box body 12), and electrically connects the associated circuits together.

An internal space of the box body 12, defined by a frame-like wall, is partitioned into chambers by partition walls 14, and these chambers serve as receiving spaces 15, 16, 17 and 18 for the electrical part blocks 25 and the lamp system control unit 24. The first to third receiving spaces 15, 16 and 17 are receiving spaces for respectively receiving the electrical part blocks 25 which are to be earlier mounted on the box body, while the fourth receiving space 18 is a receiving space for receiving the lamp system control unit 24 which is to be later mounted on the box body. At least one lock portion 21 is formed on the inner surface 20 of each of the receiving spaces 15, 16, 17 and 18, and lock portions of the electrical part blocks 25 and lamp system control unit 24 are adapted to be engaged with these lock portions 21, respectively.

The covers (not shown) close the upper and lower openings 23 of the block body 12, respectively, for waterproof and dustproof purposes. When the box body 12 is of such a type (although not shown in the drawings) that the upper and lower openings 23 are closed from the beginning, it is not necessary to provide the covers for respectively closing the openings 23.

Each of the electrical part blocks 25 includes a resin-molded board 25*d* on which the parts, such as the relays 25*a*, the fuses 25*b* and the directly-mounting connector 25, are collectively mounted, and circuits such as a relay circuit, a fuse circuit and a connector circuit are formed on the electrical part blocks 25. The electrical part blocks 25 are detachably mounted on the box body 12 through the lock structure.

The lamp system control unit 24 is an electronic control device in which electronic parts (such as a microcomputer and elements), forming an electronic circuit, are mounted on a board. Like the electronic part blocks 25, this lamp system control unit is detachably mounted on the box body 12. Other examples of electronic control devices include an ABS unit, an automatic transmission unit and an air bag unit, and instead of the lamp system control unit 24, any of these electronic control devices can be mounted on the electric connection box 10 of the invention.

The wire harness supplies a power current to the relay circuit, fuse circuit, etc., of the electrical part blocks 25, and transmits a signal current to the control circuit of the lamp system control unit 24, and electrically connects the internal circuits to external circuits. The wire harness for connection to the lamp system control unit 24 includes wires, extending from the electrical part blocks 25, and external wires, and the male connector 33 is provisionally attached to the provisionally-attaching portion 27 formed on and projecting from the inner surface 20 of the box body 12, and therefore this wire harness is prevented from hanging in midair.

When the lamp system control unit 24 is to be later mounted on the box body 12, the provisionally-attached male connector 33 is detached from the provisionally-attaching portion, and is connected to the female connector provided at the lamp system control unit 24. Therefore, even when the box body 12 is transported to another place before assembling the electric connection box 10, the wire harness will not be entangled, and also the connector 33, connected to the end portion of the wire harness, will not be caught by other part, and therefore will not be damaged.

Another feature of the invention resides in the fact that the provisionally-attaching portion 27 is formed on the inner surface 20 of the box body 12, and is disposed between the inner surface 20 of the box body 12 and the lamp system control unit 24. The provisionally-attaching portion 27 can be formed on either of the inner surface 20 and outer surface of the wall of the box body 12. However, when this provisionally-attaching portion is formed on the inner surface 20 of the box body 12, the wire harness and the male connector 33 are effectively prevented from interfering with other part.

The provisionally-attaching portion 27 is disposed between two reinforcing ribs 22 formed on and projecting from the inner surface 20 of the box body 12, and the amount of projecting of the provisionally-attaching portion 27 is generally equal to the amount of projecting of the reinforcing ribs 22, and therefore the receiving space 18 for the lamp system control unit 24 is prevented from being made smaller in size as compared with the conventional construction. In other words, the provisionally-attaching portion 27 can be additionally formed without the need for changing the size of the box body 12, and the molding of the electric connection box 10 can be effected at low costs.

Figure 2:
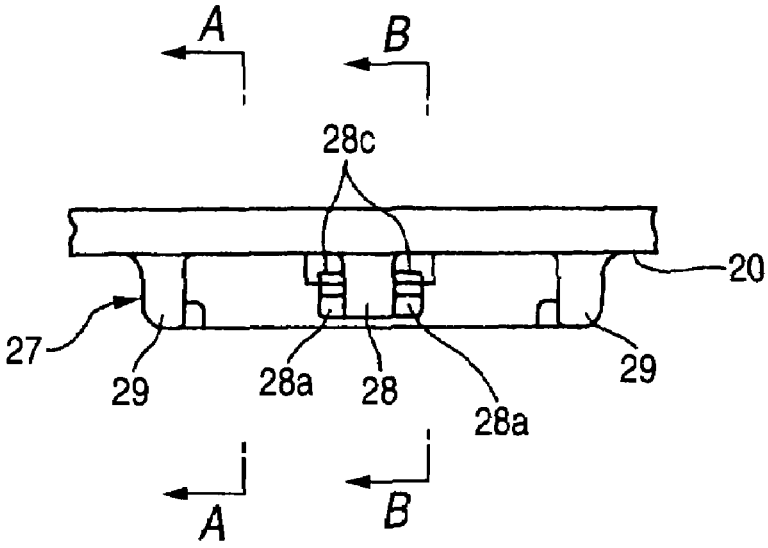
FIG. 2 is an enlarged view of a portion A of the electric connection box of FIGS. 1A–1C.
Figure 3:
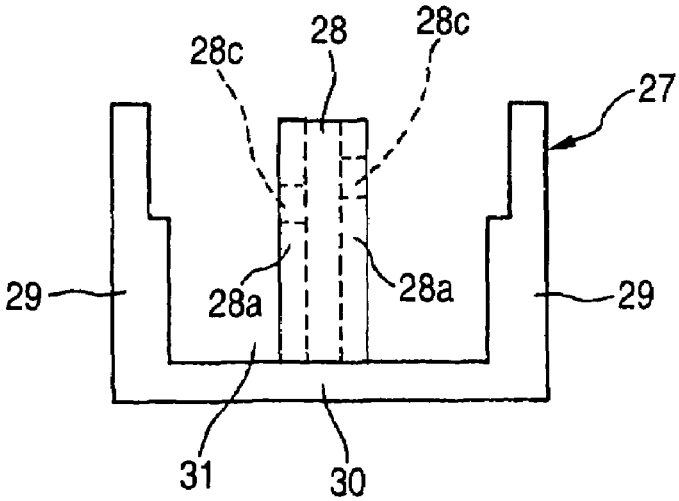
FIG. 3 is a front-elevational view of a provisionally-attaching portion shown in FIG. 2.
Figure 4A:
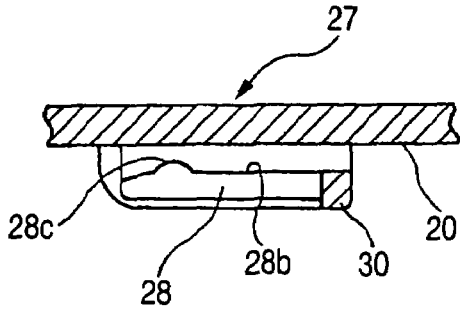
FIG. 4A is a cross-sectional view of the provisionally-attaching portion taken along the line B—B of FIG. 2.
Figure 4B:
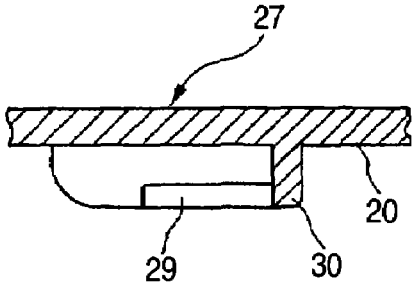
FIG. 4B is a cross-sectional view taken along the line A—A of FIG. 2.

As shown in FIGS. 2 and 3, the provisionally-attaching portion 27 includes a guide rib 28 of a T-shaped cross-section, a pair of side ribs 29 and 29 disposed respectively on opposite sides of the guide rib 28 in spaced relation thereto, and an interconnecting portion 30 interconnecting lower ends of the guide ribs and two side ribs 29 and 29.

The guide rib 28 is engaged in a guide groove 34 (see FIG. 5) of the male connector 33 so as to guide the sliding movement of the male connector 33, and a pair of overhang portions 28*a* and 28*a*, formed on the guide rib 28, prevent the disengagement of the male connector 33. The guide rib 28 extends parallel to the pair of side ribs 29 and 29, and the amount of projecting of this guide rib 28 is smaller than the amount of projecting of each side rib 29.

Retaining projections 28*c* of a generally semi-circular shape are formed on reverse surfaces 28*b* of the pair of overhang portions 28*a* and 28*a*, respectively. These retaining projections 28*c* are engaged respectively with retaining steps 35*a* (see FIG. 6) formed respectively on a pair of flange walls 35 and 35 of the guide groove 34, thereby preventing the male connector 33 from being withdrawn in a direction opposite to the sliding direction.

Figure 8:
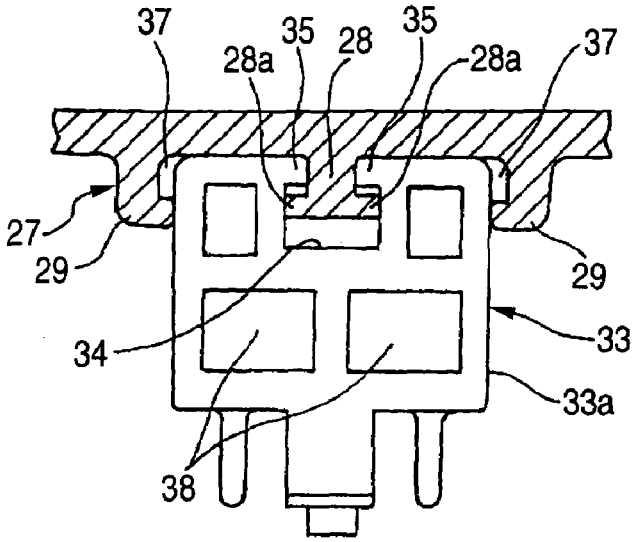
FIG. 8 is a partly cross-sectional view showing a condition in which the male connector is provisionally attached to the provisionally-attaching portion.
Figure 9:
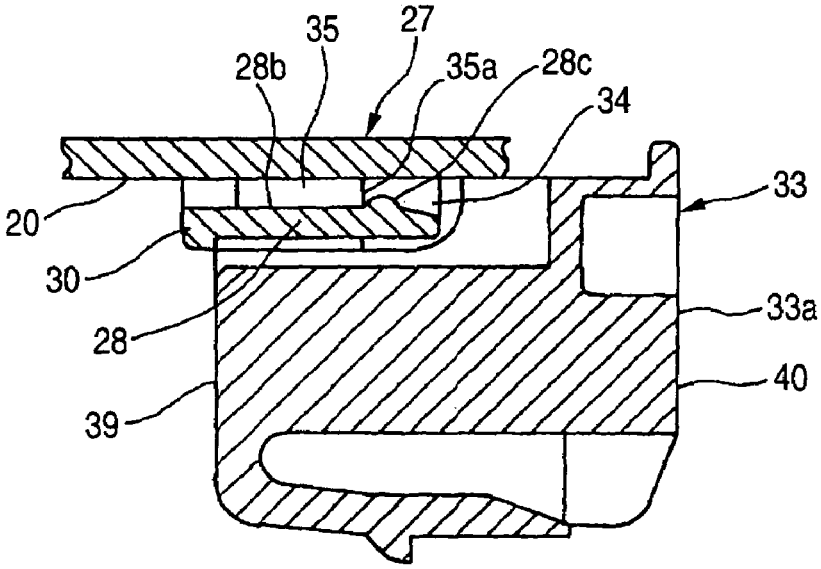
FIG. 9 is a cross-sectional view showing a condition in which the male connector is provisionally attached to the provisionally-attaching portion.
Figure 10:
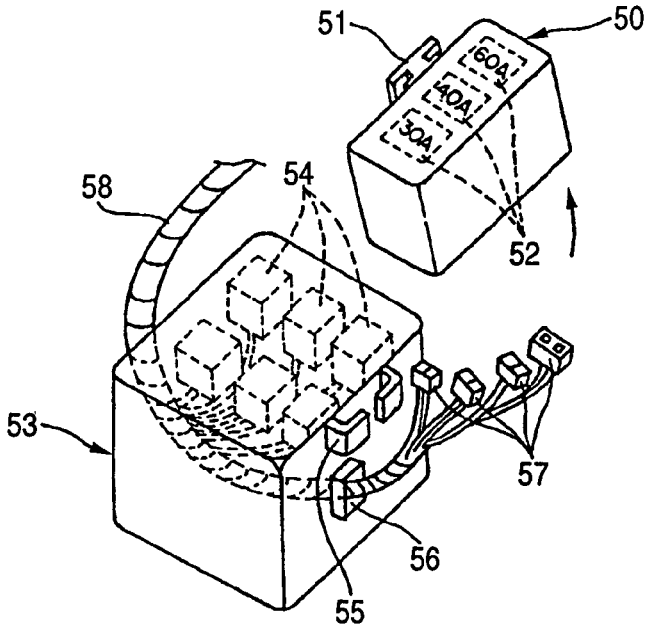
FIG. 10 PRIOR ART
FIG. 10 is a perspective view of one example (first conventional example) of conventional electric connection boxes.
Figure 11:
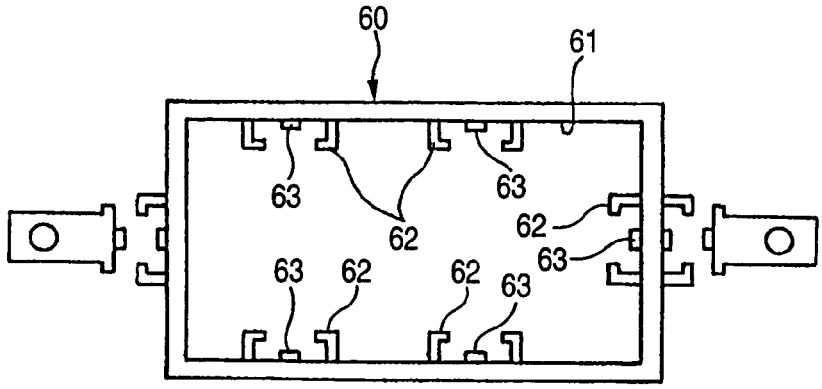
FIG. 11 PRIOR ART
FIG. 11 is a plan view of another example (second conventional example) of conventional electric connection boxes.
Figure 12:
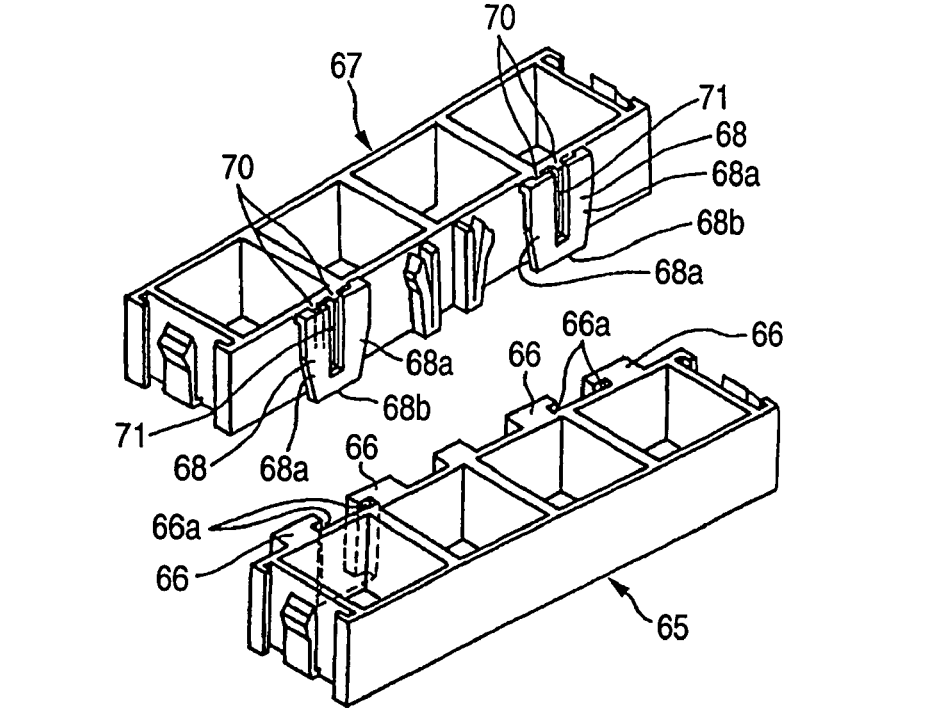
FIG. 12 PRIOR ART
FIG. 12 is a perspective view of one example (third conventional example) of lock structures of conventional electric connection boxes.
Figure 13:
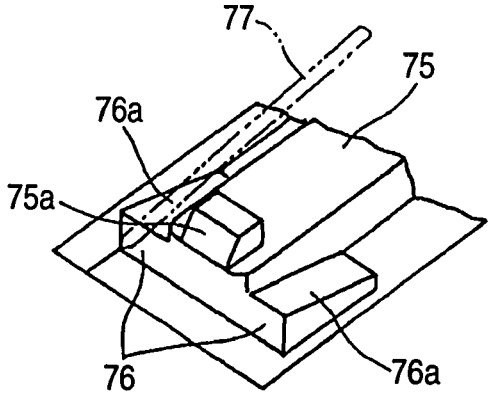
FIG. 13 PRIOR ART
FIG. 13 is a perspective view of one example (fourth conventional example) of conventional lock cancellation structures.

Namely, the pair of the flange walls 35 and 35 of the guide groove 34 are disposed in close, opposed relation to each other, and a proximal end portion of the guide rib 28 is held between the pair of flange walls 35 and 35, and also reverse surfaces of the pair of flange walls 35 and 35 are held in sliding contact with the reverse surfaces 28*b* of the pair of overhang portions 28*a* and 28*a* (see FIG. 8). When the flange walls 35 pass respectively past the retaining projections 28*c*, the retaining steps 35*a* are retained by the retaining projections 28*c*, respectively, thereby preventing the withdrawal of the male connector 33 (see FIG. 9).

Each retaining projection 28*c* is formed into a generally semi-circular cross-section, and therefore the male connector 33 can be smoothly slid in the opposite directions (that is, the connecting-inserting direction and the connector-withdrawing direction) without being caught. Therefore, the attachment and detachment of the male connector 33 can be easily carried out, and the efficiency of the operation for connecting the connector to the female connector of the lamp system control unit 24 (which is to be later mounted on the box body) can be enhanced.

The pair of side ribs 29 and 29 and the interconnecting portion 30 are interconnected to assume a generally U-shape, and part of the male connector 33 is slid into an internal insertion space 31 formed by these portions. A lower half portion of each of the two side ribs 29 and 29 is formed into an L-shaped cross-section, and when the male connector 33 is inserted into the insertion space 31, side guides 37 (see FIG. 7), formed on and projecting respectively from opposite side surfaces 41*a* and 41*a* of the male connector 33, are engaged with these lower half portions, respectively, to prevent the male connector 33 from being accidentally withdrawn. Thus, the male connector 33 is engaged with the guide rib 28 and also with the pair of side ribs 29 and 29, and therefore is positively prevented from being withdrawn from the provisionally-attaching portion 27.

The interconnecting portion 30 has the function of preventing the pair of side ribs 29 and 29 from falling, and also has a stopper function of stopping the slidingly-inserted male connector 33, and therefore the male connector 33 can be provisionally attached to the provisionally-attaching portion in a fully-inserted condition without shaking.

The amount of projecting of each of the two side ribs 29 and 29 is larger than the amount of projecting of the guide rib 28, and is generally equal to the amount of projecting of the reinforcing ribs 22 formed on the inner surface 20 of the box body 12 as described above. Therefore, the lamp system control unit 24 can be received in the receiving space 18, having generally the same size as in the conventional construction, without interference with the provisionally-attaching portion and without the need for increasing the size of the box body 12.

Figure 5:
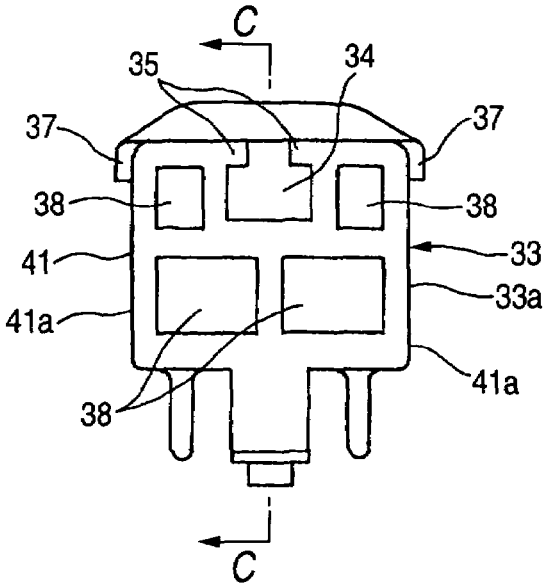
FIG. 5 is a plan view of a male connector for being provisionally attached to the provisionally-attaching portion of FIG. 2.
Figure 6:
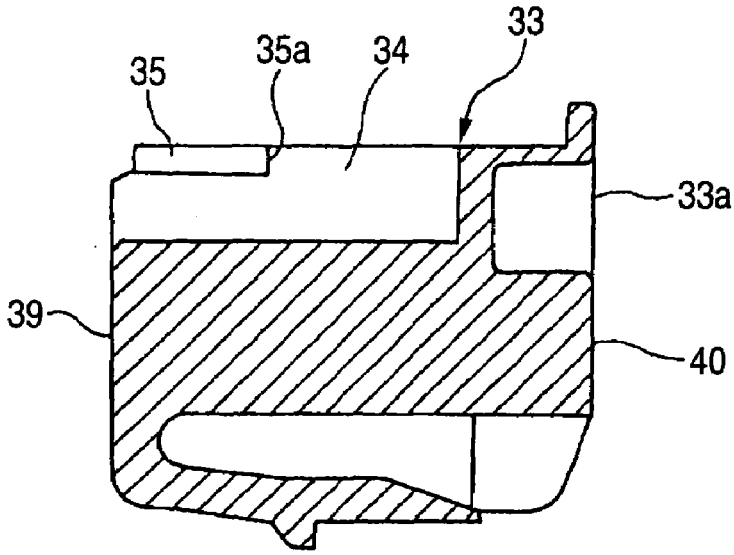
FIG. 6 is a cross-sectional view of the male connector taken along the line C—C of FIG. 5.
Figure 7:
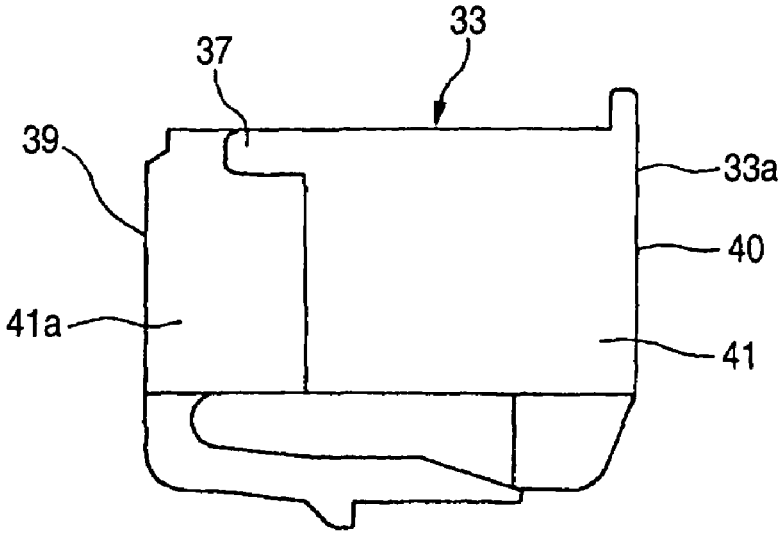
FIG. 7 is a side-elevational view of the male connector.

The 4-pole male connector 33 for being provisionally attached to the box body 12 is shown in FIGS. 5 to 7 (Terminals are not shown). This male connector 33 has a box-like shape, and an outer wall of this connector is formed by front and rear walls 39 and 40 (each having ports communicating respectively with terminal receiving chambers 38) and a peripheral wall 41 which is integrally connected to the front and rear walls 39 and 40, and is disposed perpendicular thereto.

The guide groove 34 for engagement with the guide rib 28 of the provisionally-attaching portion 27 is formed in a central portion of a generally upper half portion of the male connector housing 33*a*. The pair of opposed flange walls 35 for being retained respectively by the overhang portions 28*a* of the guide rib 28 are formed at an inlet portion of the guide groove 34. The pair of flange walls 35 serve also as part of the outer wall of the male connector housing 33*a*. The proximal end portion of the guide rib 28 is adapted to be held between the pair of flange walls 35 (see FIG. 8). The retaining steps 35*a* for being retained respectively by the retaining projections 28*c* of the overhang portions 28*a* are formed at the rear ends of the flange walls 35, respectively (see FIG. 9).

The pair of side guides 37 and 37 for engagement respectively with the pair of side ribs 29 and 29 of the provisionally-attaching portion 27 are formed on and project respectively from the opposite side surfaces 41*a* and 41*a* of the peripheral wall 41. As shown in FIG. 8, the pair of side guides 37 and 37 are engaged respectively in recesses formed respectively by the pair of side ribs 29 and 29, thereby preventing the male connector 33 from being withdrawn in a direction away from the inner surface 20 of the box body 12.

Thus, in the electric connection box 10 of the invention and the method of assembling it, the provisionally-attaching portion 27 to which the male connector 33 can be provisionally attached is formed on the inner surface 20 of the box body 12 adapted to be mounted in the engine room or other portion of the automobile. Therefore, the wire harness, connected to the electrical part blocks 25, will not hang in midair, and during the transport of the box body 12 on which the lamp system control unit 24 is not yet mounted, the wire harness will not be entangled, and also the male connector 33 is prevented from being caught by other part. And besides, the male connector 33 can be easily detached from the provisionally-attaching portion 27, and the efficiency of the operation for connecting the connector to the female connector of the lamp system control unit 24 can be enhanced.

As described above, according to the invention, the the provisionally-attaching portion to which the one connector, connected to the end portion of the wire harness extending from the box body, can be detachably attached is formed on the wall portion of the box body. Therefore, the wire harness will not hang in midair from the box body. Therefore, the wire harness will not be entangled, and also the connector is prevented from being caught and damaged, so that the reliability of the electrical connection of the electric connection box is enhanced in quality.

According to the invention, the one connector is provisionally attached to the receiving space portion within the box body, and therefore the wire harness and the one connector are not exposed to the exterior of the box body. Further, there is achieved an advantage that the wire harness and the connector are prevented from interfering with an external part or the like and therefore from being damaged.

According to the invention, the guide rib is provided as the provisionally-attaching portion, and the guide groove is provided as the engagement portion. Therefore, when the guide groove is engaged with the guide rib, the one connector is provisionally attached to the provisionally-attaching portion, and is prevented from being accidentally withdrawn from the provisionally-attaching portion.

According to the invention, the guide rib and the pair of side ribs are provided as the provisionally-attaching portion, and the guide groove and the side guides are provided as the engagement portion. Therefore, the guide groove is engaged with the guide rib, and the pair of side guides are engaged with the pair of side ribs, respectively, and by doing so, the one connector is provisionally attached to the provisionally-attaching portion. Therefore, the connector is more positively prevented from being accidentally withdrawn from the provisionally-attaching portion, so that the reliability of the locking engagement is enhanced.

According to the invention, the retaining projections of the generally semi-circular shape are formed respectively on the reverse surfaces of the overhang portions of the guide rib, and therefore the one connector can be smoothly slid in the opposite directions (that is, the connecting-inserting direction and the connector-withdrawing direction) without being caught. Therefore, the attachment and detachment of the connector can be easily carried out.

According to the invention, the box body, having the one connector provisionally attached to the provisionally-attaching portion, is transported, and therefore the wire harness is prevented from hanging in midair from the box body. When the circuit unit is to be later mounted on the box body, the provisionally-mounted one connector is detached from the provisionally-attaching portion, and is connected to the other connector provided at the circuit unit, and subsequently the circuit unit is mounted on the box body. Therefore, damage due to the entanglement of the wire harness and the catching of the connector is prevented, and the assembling of the electric connection box can be efficiently carried out continuously, so that the efficiency of the operation for assembling the electric connection box is enhanced.

What is claimed is:

1. An electric connection box comprising:

a box body;

a provisionally-attaching portion provided on the box body for provisionally attaching a first connector, connected to a wire harness, to the box body, the first connector being disposed in a receiving space; and a circuit unit including a second connector adapted to be mounted on the box body, wherein when the circuit unit is mounted to the box body, the first connector is detached from the provisionally-attaching portion and is connected to the second connector and the circuit unit replaces the first connector in the receiving space.

2. The electric connection box according to claim 1, wherein the provisionally-attaching portion is formed on a wall portion of the box body forming the receiving space for receiving the circuit unit, and when the circuit unit is received in the receiving space, the provisionally-attaching portion is disposed between the wall portion and the circuit unit.

3. The electric connection box according to claim 2, wherein the provisionally-attaching portion includes a guide rib which is formed on the wall portion and extends in a direction in which the first connector is inserted, and the first connector includes a guide groove for sliding engagement with the guide rib.

4. The electric connection box according to claim 3, wherein the provisionally-attaching portion includes a pair of side ribs provided at opposite sides of the guide rib, respectively, and the first connector includes a pair of side guides for engagement respectively with the pair of side ribs.

5. The electric connection box according to claim 3, wherein the provisionally-attaching portion includes retaining projections having a generally semi-circular cross-section formed respectively on a pair of overhang portions formed respectively on opposite sides of the guide rib, and the first connector includes retaining steps for being retained respectively by the retaining projections formed respectively on flange walls of the guide groove.

6. A method of assembling an electric connection box comprising the steps of:

provisionally-attaching a first connector connected to a wire harness to a provisionally-attaching portion provided on a box body such that the first connector is received in a receiving space;

transporting the box body in a state that the first connector is provisionally-attached to the provisionally-attaching portion;

detaching the first connector from the provisionally-attaching portion and mounting a circuit unit, including a second connection, in the receiving space of the box body; and connecting the first connector to the second connector.

* * * * *